US010519589B2

(12) United States Patent
Beres et al.

(10) Patent No.: US 10,519,589 B2
(45) **Date of Patent: *Dec. 31, 2019**

(54) LAUNDRY TREATING APPLIANCE DETERGENT DISPENSER

(71) Applicant: WHIRLPOOL CORPORATION, Benton Harbor, MI (US)

(72) Inventors: Benjamin A. Beres, South Haven, MI (US); Paul E. Brownie, Benton Harbor, MI (US); Eric A. Gallagher, Kalamazoo, MI (US); Guy M. Kazmierzak, Dowagiac, MI (US); Andrew C. Kubasiak, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 171 days.

This patent is subject to a terminal disclaimer.

(21) Appl. No.: 15/443,372

(22) Filed: Feb. 27, 2017

(65) Prior Publication Data

US 2018/0245265 A1 Aug. 30, 2018

(51) Int. Cl.

| | |
|---|---|
| ***D06F 39/02*** | (2006.01) |
| ***D06F 23/04*** | (2006.01) |
| ***D06F 37/24*** | (2006.01) |
| ***D06F 39/08*** | (2006.01) |
| ***D06F 33/02*** | (2006.01) |

(52) U.S. Cl.

CPC ..... *D06F 39/028* (2013.01); *D06F 37/24* (2013.01); *D06F 39/02* (2013.01); *D06F 39/022* (2013.01); *D06F 39/083* (2013.01); *D06F 23/04* (2013.01); *D06F 33/02* (2013.01); *D06F 39/088* (2013.01); *D06F 2202/04* (2013.01); *D06F 2204/088* (2013.01)

(58) Field of Classification Search

CPC ..... D06F 39/028; D06F 23/04; D06F 33/02; D06F 37/24; D06F 39/083; D06F 39/022; D06F 39/02; D06F 39/088; D06F 2202/04; D06F 2204/088

See application file for complete search history.

(56) References Cited

U.S. PATENT DOCUMENTS

| | | | | |
|---|---|---|---|---|
| 3,026,699 | A * | 3/1962 | Rhodes | D06F 29/00 68/12.19 |
| 3,039,286 | A * | 6/1962 | Shelton | D06F 29/00 137/312 |
| 3,392,747 | A | 7/1968 | Waldrop | |
| 5,253,493 | A * | 10/1993 | Ohashi | D06F 39/14 220/812 |
| 7,296,443 | B2 * | 11/2007 | Usherovich | D06F 39/14 312/228.1 |
| 9,200,399 | B2 | 12/2015 | Kim et al. | |
| 9,217,215 | B2 | 12/2015 | Kim et al. | |

(Continued)

FOREIGN PATENT DOCUMENTS

EP 0484607 A1 5/1992

*Primary Examiner* — Benjamin L Osterhout
(74) *Attorney, Agent, or Firm* — McGarry Bair PC

(57) ABSTRACT

A laundry treating appliance includes a cabinet defining an interior and having an access opening to the interior, a treating chamber located within the interior and accessible through the access opening, a dispenser having a drawer with at least one chemistry container and a faucet, and a water supply fluidly coupled to the faucet.

20 Claims, 8 Drawing Sheets

(56) References Cited

U.S. PATENT DOCUMENTS

| | | | | |
|---|---|---|---|---|
| 9,879,371 | B2 | 1/2018 | Leibman et al. | |
| 2002/0134117 | A1* | 9/2002 | Arai | D06F 19/00 68/3 SS |
| 2005/0072194 | A1* | 4/2005 | Ryohke | D06F 19/00 68/3 R |
| 2007/0056330 | A1 | 3/2007 | Song | |
| 2007/0084000 | A1 | 4/2007 | Bernardino et al. | |
| 2010/0281927 | A1* | 11/2010 | Lee | D06F 17/04 68/200 |
| 2015/0059418 | A1 | 3/2015 | Lee et al. | |
| 2015/0247274 | A1* | 9/2015 | Kim | D06F 39/08 68/27 |
| 2016/0138207 | A1* | 5/2016 | Del Pos | D06F 39/02 68/17 R |

* cited by examiner

LAUNDRY TREATING APPLIANCE DETERGENT DISPENSER

BACKGROUND OF THE INVENTION

Laundry treating appliances, such as washing machines, refreshers, and non-aqueous systems, can have a configuration based on a rotating container that at least partially defines a treating chamber in which laundry items are placed for treating. The laundry treating appliance can have a controller that implements a number of user-selectable, pre-programmed cycles of operation. Hot water, cold water, or a mixture thereof along with various treating chemistries, or detergents, can be supplied to the treating chamber in accordance with the cycle of operation.

In vertical axis washing machines a detergent dispenser can be in the form of a drawer fluidly coupled to the treating chamber to receive a volume of detergent to treat the laundry items according to the cycle of operation. The drawer usually includes containers for treating chemistries such as detergent or fabric softener and can supply the treating chemistries to the treating chamber via a conduit.

BRIEF SUMMARY OF THE INVENTION

In one aspect, illustrative embodiments in accordance with the present disclosure relate to a laundry treating appliance including a cabinet defining an interior and having an access opening to the interior, a treating chamber located within the interior and accessible through the access opening, a pre-treatment faucet having an outlet fluidly coupled to the treating chamber, and a dispenser having containers, wherein at least one of the containers directs a pre-treatment water flow from a water supply to the outlet in response to user actuation, and at least one of the containers dispenses treating chemistry during operation of the laundry treating appliance.

In another aspect, illustrative embodiments in accordance with the present disclosure relate to a laundry treating appliance a laundry treating appliance including a cabinet defining an interior and having a shroud defining an access opening to the interior, a basket located within the interior, the basket having an open top and rotatable about a vertical axis, a faucet having an outlet located within the shroud, a dispenser drawer carrying the faucet and slidable relative to the shroud between a first position, where at least one of the containers underlies the shroud, and a second position, where the at least one of the containers extends at least partially beyond the shroud and overlies the basket, and a pre-treatment water supply comprising a water line fluidly coupled to at least one of the containers, a conduit coupling the at least one of the containers to the outlet, a valve, and an actuator accessible by a user, wherein actuation of the actuator controls an opening/closing of the valve to control a supply of water to the outlet via the at least one container.

DETAILED DESCRIPTION OF EMBODIMENTS OF THE INVENTION

Prior to running a cycle of operation for treating laundry items a user may desire to pre-treat laundry items to more effectively treat the laundry items. Pre-treating is typically performed in an external utility sink or space in a user's laundry room. However not all laundry rooms are equipped with an external utility sink or space. Integration of a water supply in accordance with the present disclosure enables a user to pre-treat laundry items without the use of an external sink or space. In one aspect, such pre-treatment is achieved by providing a faucet within a dispenser drawer. In another aspect, this is achieved by providing a faucet having an outlet fluidly coupled to a treating chamber. The faucet, or outlet thereof, can be provided on mechanical structures associated with the treating chamber or an access opening to the treating chamber, such as a shroud surrounding the access opening. However, the faucet or outlet can be provided on any mechanical structure accessible by a user and adjacent the treating chamber.

Figure 1:
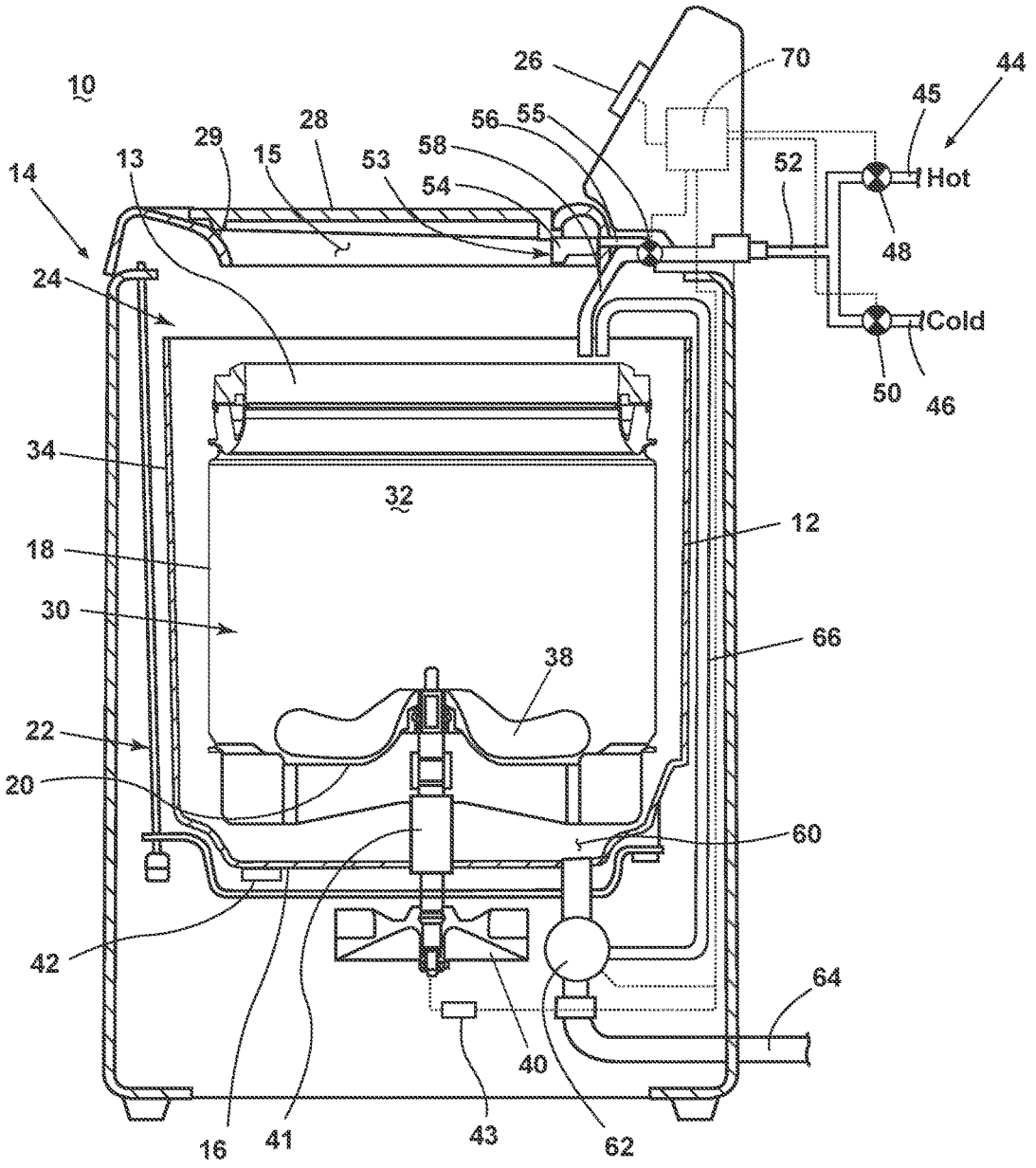
FIG. 1 illustrates a schematic cross-sectional view of a laundry treating appliance in the form of a washing machine according to various aspects described herein.

FIG. 1 is a schematic sectional view of a laundry treating appliance shown in the form of a washing machine 10 according to one embodiment of the invention. While the laundry treating appliance is illustrated as a vertical axis, top-fill washing machine, the embodiments of the invention can have applicability in other fabric treating appliances, non-limiting examples of which include a horizontal axis washing machine, a combination washing machine and dryer, a refreshing/revitalizing machine, an extractor, or a non-aqueous washing apparatus.

Washing machines are typically categorized as either a vertical axis washing machine or a horizontal axis washing machine. As used herein, the "vertical axis" washing machine refers to a washing machine having a rotatable drum, perforate or imperforate, that holds fabric items in a treating chamber and a clothes mover, such as an agitator, impeller, nutator, and the like within the drum. The clothes mover moves within the drum to impart mechanical energy directly to the clothes or indirectly through wash liquid in the drum. The clothes mover may typically be moved in a reciprocating rotational movement. In some vertical axis washing machines, the drum, including the treating chamber, rotates about a vertical axis generally perpendicular to a surface that supports the washing machine. However, the rotational axis need not be vertical. The drum may rotate about an axis inclined relative to the vertical axis. As used herein, the "horizontal axis" washing machine refers to a washing machine having a rotatable drum, perforated or imperforate, that holds fabric items and washes the fabric items by the fabric items rubbing against one another as the drum rotates. In some horizontal axis washing machines, the drum rotates about a horizontal axis generally parallel to a surface that supports the washing machine. However, the rotational axis need not be horizontal. The drum may rotate about an axis inclined relative to the horizontal axis. In horizontal axis washing machines, the clothes are lifted by the rotating drum and then fall in response to gravity to form a tumbling action. Mechanical energy is imparted to the clothes by the tumbling action formed by the repeated lifting and dropping of the clothes. Vertical axis and horizontal axis machines are best differentiated by the manner in which they impart mechanical energy to the fabric articles. The illustrated exemplary washing machine of FIG. 1 is a vertical axis washing machine.

As illustrated in FIG. 1, the washing machine 10 can include a structural support system comprising a cabinet 14 that defines a housing, within which a laundry holding system resides. An access opening 15 can be provided in the cabinet 14 to access the laundry holding system. The cabinet 14 can be a housing having a chassis and/or a frame, to which decorative panels may or may not be mounted, defining an interior that receives components typically found in a conventional washing machine, such as motors, pumps, fluid lines, controls, sensors, transducers, and the like. Such components will not be described further herein except as necessary for a complete understanding of the invention.

The fabric holding system of the illustrated exemplary washing machine 10 can include a rotatable basket 30 having an open top 13 that can be disposed within the interior of the cabinet 14 and may define a treating chamber 32 for receiving laundry items for treatment. The open top can be aligned with the access opening 15. A tub 34 can also be positioned within the cabinet 14 and can define an interior 24 within which the basket 30 can be positioned. The tub 34 can have a generally cylindrical side or tub peripheral wall 12 closed at its bottom end by a base 16 that can at least partially define a sump 60.

The basket 30 can have a generally peripheral side wall 18, which is illustrated as a cylindrical side wall, closed at the basket end by a basket base 20 to at least partially define the treating chamber 32. The basket 30 can be rotatably mounted within the tub 34 for rotation about a vertical basket axis of rotation and can include a plurality of perforations, such that liquid may flow between the tub 34 and the rotatable basket 30 through the perforations. While the illustrated washing machine 10 includes both the tub 34 and the basket 30, with the basket 30 defining the treating chamber 32, it is within the scope of the invention for the laundry treating appliance to include only one receptacle, with the receptacle defining the laundry treatment chamber for receiving the load to be treated.

A shroud 29 is provided at the top of the cabinet 14 and can define the access opening 15. The shroud 29 can curve downwards toward the treating chamber 32 to direct laundry items into the basket 30. The shroud 29 can overlie a portion of the basket 30 such that the laundry items do not fall between the basket 30 and the tub 34. A selectively openable lid 28 can provide access into the laundry treating chamber 32 through the access opening 15 of the basket 30.

A laundry mover 38 may be rotatably mounted within the basket 30 to impart mechanical agitation to a load of laundry placed in the basket 30. The laundry mover 38 can be oscillated or rotated about its vertical axis of rotation during a cycle of operation in order to produce load motion effective to wash the load contained within the treating chamber 32. Other exemplary types of laundry movers include, but are not limited to, an agitator, a wobble plate, and a hybrid impeller/agitator.

The basket 30 and the laundry mover 38 may be driven by a drive system 40 that includes a motor 41, which can include a gear case, operably coupled with the basket 30 and laundry mover 38. The motor 41 can rotate the basket 30 at various speeds in either rotational direction about the vertical axis of rotation, including at a spin speed wherein a centrifugal force at the inner surface of the basket side wall 18 is 1 g or greater. Spin speeds are commonly known for use in extracting liquid from the laundry items in the basket 30, such as after a wash or rinse step in a treating cycle of operation. A loss motion device or clutch (not shown) can be included in the drive system 40 and can selectively operably couple the motor 41 with either the basket 30 and/or the laundry mover 38.

A suspension system 22 can dynamically hold the tub 34 within the cabinet 14. The suspension system 22 can dissipate a determined degree of vibratory energy generated by the rotation of the basket 30 and/or the laundry mover 38 during a treating cycle of operation. Together, the tub 34, the basket 30, and any contents of the basket 30, such as liquid and laundry items, define a suspended mass for the suspension system 22.

A liquid supply system can be provided to liquid, such as water or a combination of water and one or more wash aids, such as detergent, into the treating chamber 32. The liquid supply system can include a water supply 44 configured to supply hot or cold water. The water supply 44 can include a hot water inlet 45 and a cold water inlet 46. A valve assembly can include a hot water valve 48, a cold water valve 50, and a diverter valve 55, and various conduits 52, 56, 58 for selectively distributing the water supply 44 from the hot water and cold water inlets 45, 46. The valves 48, 50 are selectively openable to provide water, such as from a household water supply (not shown) to the conduit 52. The valves 48, 50 can be opened individually or together to provide a mix of hot and cold water at a selected temperature. While the valves 48, 50 and conduit 52 are illustrated exteriorly of the cabinet 14, it may be understood that these components can be internal to the cabinet 14.

A dispensing system 53 can be provided for dispensing treating chemistry to the basket 30, either directly or mixed with water from the water supply 44. The dispensing system 53 can include a dispenser 54, which can be a single use dispenser, a bulk dispenser, or a combination of a single use and bulk dispenser in non-limiting examples. As illustrated, the dispenser 54 can be fluidly coupled with the conduit 52 through a diverter valve 55 and a first water conduit 56. The dispensing system 53 can include means for supplying or mixing detergent to or with water from the first water conduit 56. Alternatively, water from the first water conduit 56 can also be supplied to the tub 34 through the detergent dispenser 54 without the addition of a detergent. A second water conduit, illustrated as the water inlet 58, can also be fluidly coupled with the conduit 52 through the diverter valve 55 such that water can be supplied directly to the treating chamber through the open top of the basket 30.

Non-limiting examples of treating chemistries that can be dispensed by the dispensing system during a cycle of operation include one or more of the following: water, detergents, surfactants, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof. The treating chemistries can be in the form of a liquid, powder, or any other suitable phase or state of matter.

Additionally, the liquid supply system and dispensing system 53 can differ from the configuration shown, such as by inclusion of other valves, conduits, wash aid dispensers, heaters, sensors, such as water level sensors and temperature sensors, and the like, to control the flow of treating liquid through the washing machine 10 and for the introduction of more than one type of detergent/wash aid.

A liquid recirculation system can be provided for recirculating liquid from the tub 34 into the treating chamber 32. More specifically, the sump 60 can be located in the bottom of the tub 34 and the liquid recirculation system can be configured to recirculate treating liquid from the sump 60 onto the top of a laundry load located in the treating chamber 32. A pump 62 can be housed below the tub 34 and can have an inlet fluidly coupled with the sump 60 and an outlet configured to fluidly couple to either or both a household drain 64 or a recirculation conduit 66. In this configuration, the pump 62 can be used to drain or recirculate wash water in the sump 60. As illustrated, the recirculation conduit 66 can be fluidly coupled with the treating chamber 32 such that it supplies liquid into the open top of the basket 30. The liquid recirculation system can include other types of recirculation systems.

It is noted that the illustrated drive system, suspension system, liquid supply system, recirculation and drain system are shown for exemplary purposes only and are not limited to the systems shown in the drawings and described above. For example, the liquid supply, recirculation and pump systems can differ from the configuration shown in FIG. 1, such as by inclusion of other valves, conduits, sensors (such as liquid level sensors and temperature sensors), and the like, to control the flow of liquid through the washing machine 10 and for the introduction of more than one type of treating chemistry. For example, the liquid supply system can be configured to supply liquid into the interior of the tub 34 not occupied by the basket 30 such that liquid can be supplied directly to the tub 34 without having to travel through the basket 30. In another example, the liquid supply system can include a single valve for controlling the flow of water from the household water source. In another example, the recirculation and pump system can include two separate pumps for recirculation and draining, instead of the single pump as previously described.

The washing machine 10 can also be provided with a heating system (not shown) to heat liquid provided to the treating chamber 32. In one example, the heating system can include a heating element provided in the sump to heat liquid that collects in the sump 60. Alternatively, the heating system can be in the form of an in-line heater that heats the liquid as it flows through the liquid supply, dispensing and/or recirculation systems.

The washing machine 10 can further include a controller 70 coupled with various working components of the washing machine 10 to control the operation of the working components and to implement one or more treating cycles of operation. A user interface 26 can be operably coupled with the controller 70. The user interface 26 can include one or more knobs, dials, switches, displays, touch screens and the like for communicating with the user, such as to receive input and provide output. The user can enter different types of information including, without limitation, cycle selection and cycle parameters, such as cycle options.

The controller 70 can include the machine controller and any additional controllers provided for controlling any of the components of the washing machine 10. For example, the controller 70 can include the machine controller and a motor controller. Many known types of controllers can be used for the controller 70. It is contemplated that the controller is a microprocessor-based controller that implements control software and sends/receives one or more electrical signals to/from each of the various working components to implement the control software. As an example, proportional control (P), proportional integral control (PI), and proportional derivative control (PD), or a combination thereof, a proportional integral derivative control (PID), can be used to control the various components of the washing machine 10.

Figure 2:
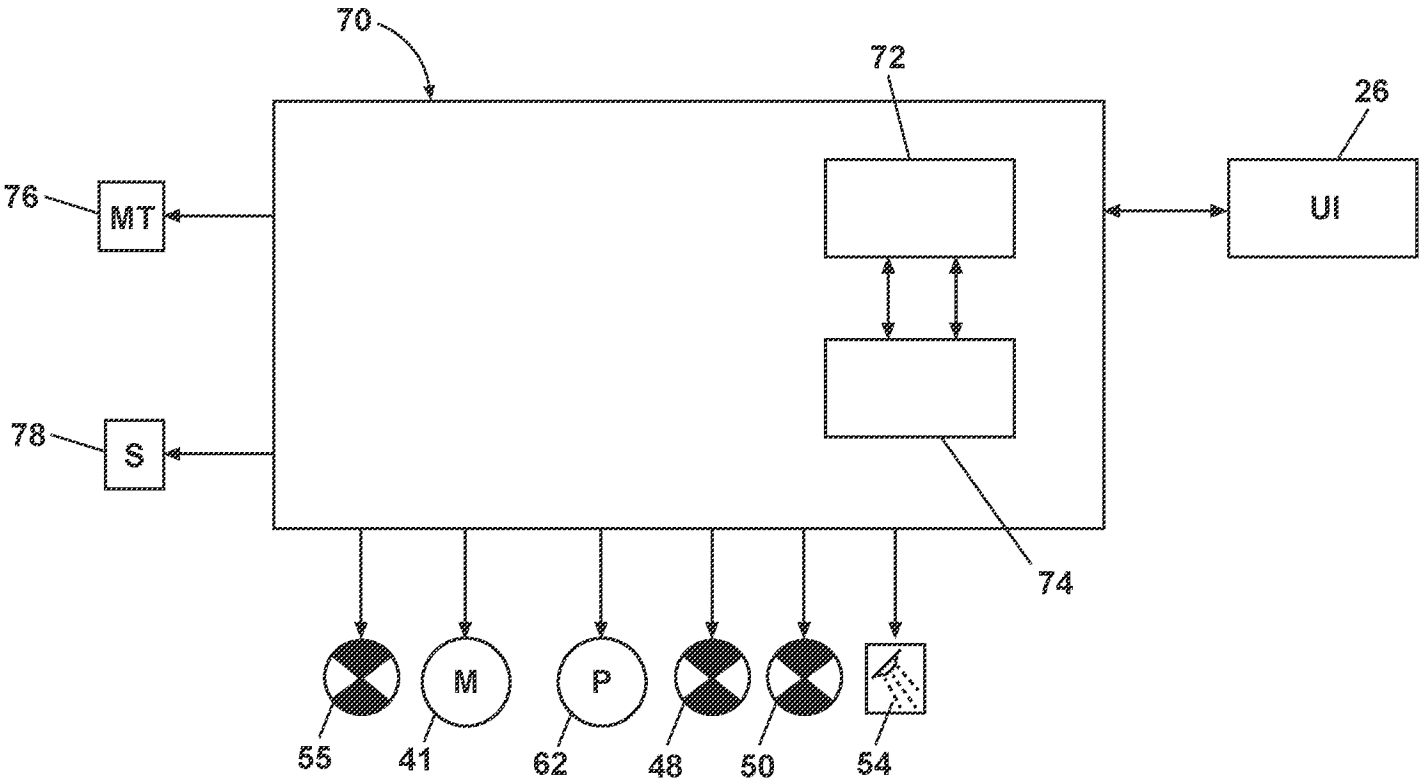
FIG. 2 illustrates a schematic representation of a controller for controlling the operation of one or more components of the laundry treating appliance of FIG. 1.

As illustrated in FIG. 2, the controller 70 can be provided with a memory 72 and a central processing unit (CPU) 74. The memory 72 can be used for storing the control software that can be executed by the CPU 74 in completing a cycle of operation using the washing machine 10 and any additional software. Examples, without limitation, of treating cycles of operation include: wash, heavy-duty wash, delicate wash, quick wash, pre-wash, refresh, rinse only, and timed wash, which can be selected at the user interface 26. The memory 72 can also be used to store information, such as a database or table, and to store data received from the one or more components of the washing machine 10 that can be communicably coupled with the controller 70. The database or table can be used to store the various operating parameters for the one or more cycles of operation, including factory default values for the operating parameters and any adjustments to them by the control system or by user input.

The controller 70 can be operably coupled with one or more components of the washing machine 10 for communicating with and/or controlling the operation of the components to complete a cycle of operation. For example, the controller 70 can be coupled with the hot water valve 48, the cold water valve 50, the diverter valve 55, and the dispenser 54 for controlling the temperature and flow rate of treating liquid into the treating chamber 32; the pump 62 for controlling the amount of treating liquid in the treating chamber 32 or sump 60; drive system 40 at the motor 41 for controlling the direction and speed of rotation of the basket 30 and/or the clothes mover 38; and the user interface 26 for receiving user selected inputs and communicating information to the user. The controller 70 can also receive input from a temperature sensor 76, such as a thermistor, which can detect the temperature of the treating liquid in the treating chamber 32 and/or the temperature of the treating liquid being supplied to the treating chamber 32. The controller 70 can also receive input from various additional sensors 78, which are known in the art and not shown for simplicity. Non-limiting examples of additional sensors 78 that can be communicably coupled with the controller 70 include a weight sensor and a motor torque sensor.

Figure 3:
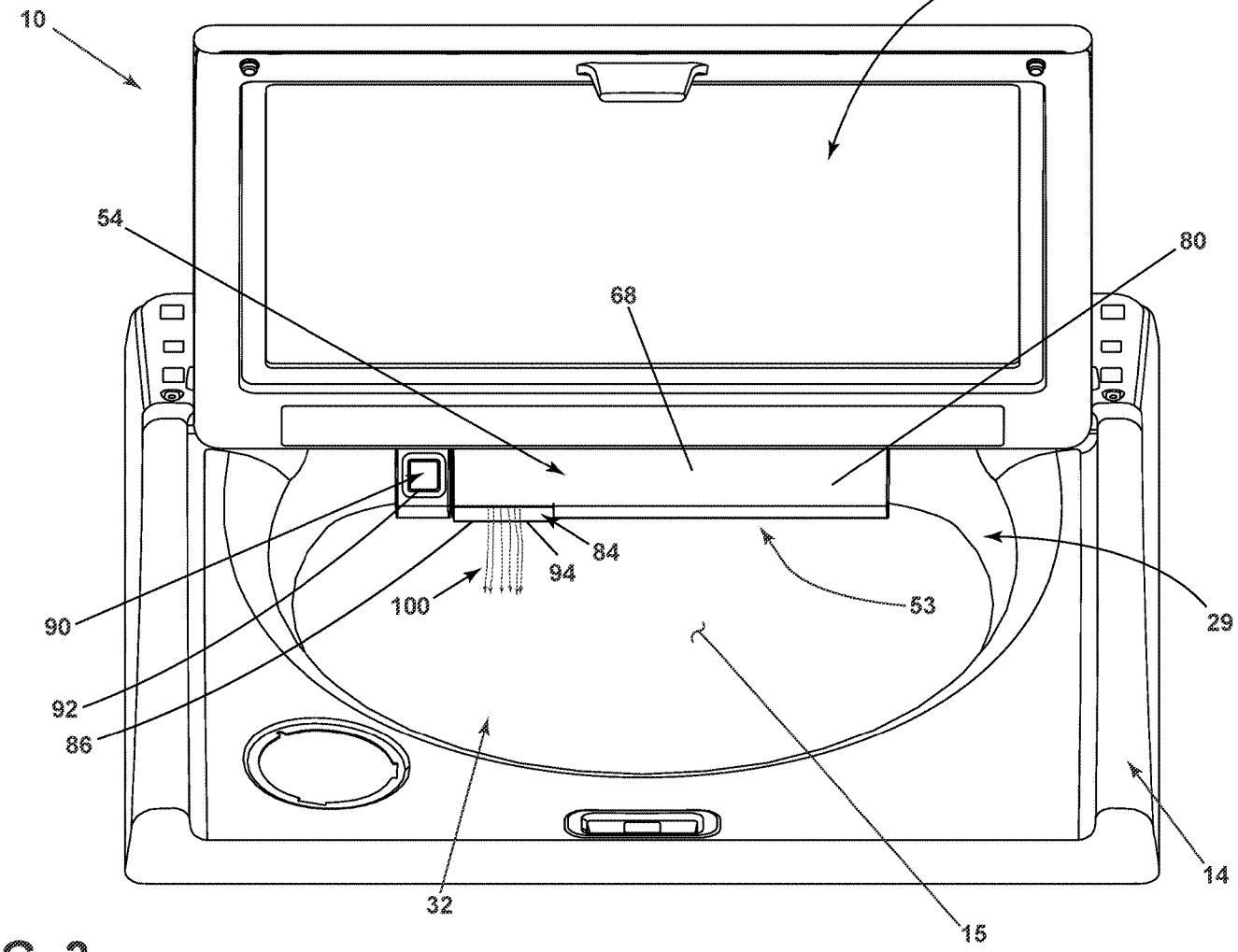
FIG. 3 illustrates a top view of an opening in the laundry treating appliance of FIG. 1 having a dispenser with a drawer in a first position according to various aspects described herein.

Looking now at the dispensing system 53 in greater detail, reference is made to FIG. 3, which illustrates a top view of a washing machine 10 showing the dispensing system 53 having a pre-treatment faucet 84. For ease of viewing, the door 28 is shown in the opened position to illustrate the relative positions of the dispenser 54, shroud 29 and access opening 15. More specifically, the dispenser 54 can be provided in (and may partially form) the shroud 29 toward the rear of the access opening 15, though any other suitable position of the dispenser 54 is contemplated. The dispenser 54 can include a drawer 80 movable or slidable between a closed, first position (FIG. 3) and an opened, second position (FIG. 4) relative to the shroud 29. The drawer 80 of the dispenser 54 can further include a front panel 68, which forms a portion of the shroud 29 in the closed, first position.

The faucet 84 can be provided on the drawer 80. The faucet 84 can underlie the shroud 29 when the drawer 80 is in the closed, first position. The faucet 84 has an outlet 86 provided in the front panel 68 of the dispenser 54. The outlet 86 can be formed as an aperture 94 in the drawer 80 or the shroud 29. A pre-treatment water flow, or supply of water 100, can be provided from the faucet 84 at the outlet 86, and dispensed to the treating chamber 32 through the access opening 15. In particular, the supply of water 100 can be provided from the dispenser 54 at the faucet 84. When the drawer 80 is in the first position the supply of water 100 can be directed in a stream flowing out of the outlet 86 in the faucet 84 and toward the treating chamber 32 in a downward direction.

An actuator 90 can operably couple to the dispenser 54 to control the supply of water 100 from the faucet 84. A user can operate the actuator 90 to utilize the faucet 84 for pre-treatment of laundry items. In this illustrative example, the actuator 90 is in the form of a switch 92. However, the actuator 90 can be any suitable actuable element, such as a switch, button, dial, or knob. The actuator 90 can be provided on the shroud 29 or the dispenser 54, such that the actuator 90 is accessible through the access opening 15 while the door 28 is in the opened position. While the actuator 90 is shown as being located on the shroud 29, the actuator 90 can be located on any other suitable location accessible by a user, such as on the cabinet 14, drawer 80, or user interface 26. The actuator 90 can be a mechanical actuator wherein the supply of water 100 is controlled by way of a mechanical operation, or the actuator 90 can be an electrical actuator wherein the supply of water 100 is controlled by way of an electric signal or current. Alternatively, it is contemplated that any suitable operable control mechanism be used to control the supply of water 100.

When the lid 28 is open, the faucet 84 is accessible and enables a user utilize the faucet 84 to dispense water onto fabric items for pre-treatment. After the lid 28 is closed and the washing machine 10 begins an automatic cycle of operation, the faucet 84 should not further dispense water. Instead, the treating chemistry containers 81, 83, 85 can dispense treating chemistry for use during the automatic cycle of operation.

In use, the faucet 84 can be used to treat a laundry item prior to the washing machine 10 running an automatic cycle of operation. In a first example, a laundry item can be placed underneath the faucet 84 in the trajectory of the supply of water 100 flowing out of the outlet 86. The user can actuate the actuator 90 to start the supply of water 100 from the faucet 84. The laundry item can be at least partially saturated with the supply of water 100. The wet laundry treating item can be treated by the user, such as rubbing or brushing a stain on the wet laundry item. In another example, before or after the laundry item is wetted using the faucet 84, a treating chemistry such as a stain-remover can be applied to the laundry item. The user can then treat the laundry item with the stain-remover having been wet by the water supplied from the faucet 84. To treat the laundry item a user may wish to scrub the wet portion of the laundry item, such as by rubbing the laundry item with a user's hands or by using a brush, sponge, or other suitable treatment utensil. In yet another example, the user could simply put the laundry item under the faucet to become at least partially saturated with the supply of water prior to running a cycle of operation, or adding treating chemistry and water to a particular laundry item or portion thereof to provide increased treatment beyond the cycle of operation alone.

Figure 4:
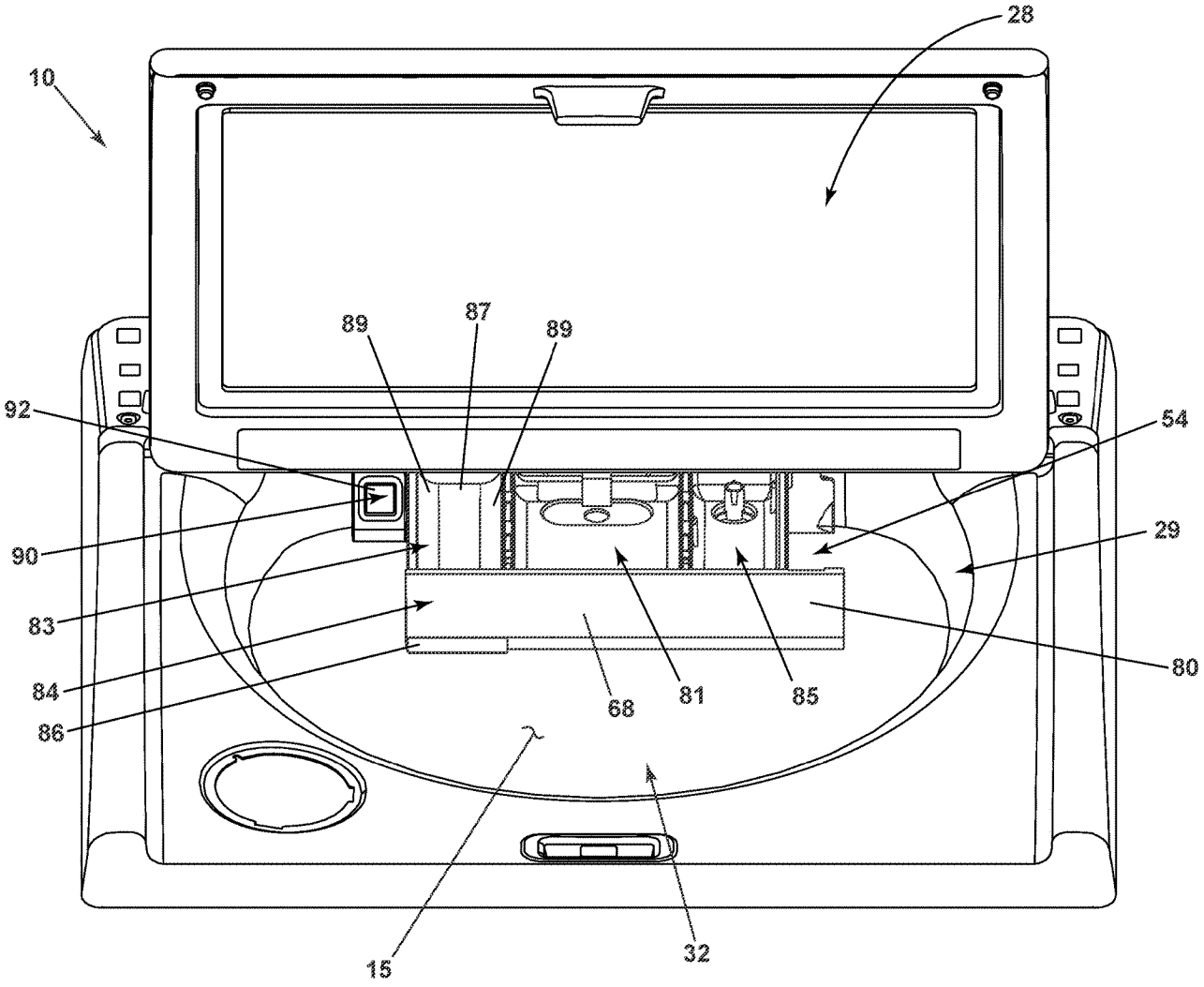
FIG. 4 illustrates a top view of the laundry treating appliance of FIG. 3 with the drawer in a second position.

FIG. 4 illustrates the washing machine 10 with the drawer 80 of the dispenser 54 slid out of the shroud 29 in the opened, second position. While the drawer 80 is in the second position, the faucet 84 can extend at least partially beyond the shroud 29 and overlie the basket 30 into the access opening 15 such that the outlet 86 extends beyond the shroud 29.

A set of one or more containers, shown here as a first container 81, a second container 83, and a third container 85, can be carried by the drawer 80. The containers 81, 83, and 85 can hold differing types of liquids or powders, such as water or treating chemistry including detergent, fabric softener, or stain repellent. It is also contemplated that at least two of the containers 81, 83, and 85 are different in volume. Furthermore, the particular containers 81, 83, and 85 can be tailored to particular treating chemistries, and can include indicia or labelling to identify the particular intended treating chemistries.

At least one of the containers 81, 83, and 85 can be adapted to facilitate water flow for the faucet 84. In this example, the second container 83 at least partially defines the faucet 84 and can include the outlet 86. As such, the drawer 80 including the second container 83 can at least partially form the faucet 84 as described herein. The second container 83 includes a bottom 87 and sides 89 such that a volume of water or treating chemistry is constrained within the second container 83. The outlet 86 can be provided in the bottom 87 or the sides 89 of the second container 83, providing egress for water or treating chemistry within the second container 83. This enables the pre-treatment water faucet functionality to be provided within the structure of the dispenser drawer 80, resulting in a simple, low-complexity, and low-cost implementation.

Figure 5:
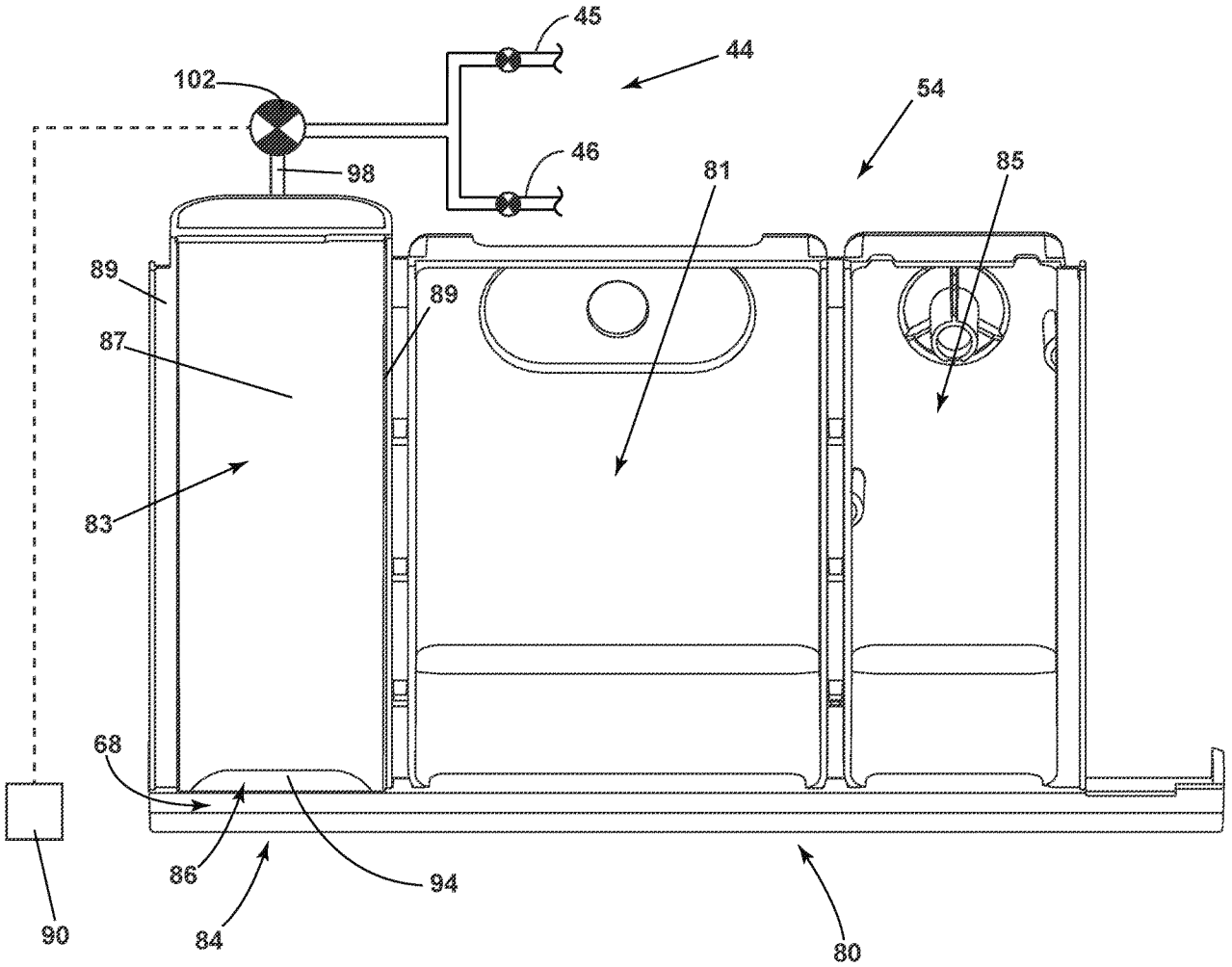
FIG. 5 illustrates a top, schematic view of the drawer of FIG. 4 according to various aspects described herein.

Turning to FIG. 5, a top view of the dispenser drawer 80 is shown schematically coupled to the water supply 44. The outlet 86 can be provided in the bottom 87 or sides 89 of the second container 83. The outlet 86 can further include a nozzle to facilitate the flow of water from the outlet 86. A water line 98 can fluidly couple the water supply 44 to the dispenser 54. The water line 98 can be coupled at the second container 83, and can be movable to accommodate slidable movement of the drawer 80. While the water line 98 is shown to only couple the second container 83, the water line 98 can fluidly couple any of the containers 81, 83, and 85. A valve 102 can be provided at a junction between the water supply 44 and the water line 98 for selectively supplying water to the water line 98. The valve 102 can be any suitable valve, such as a diverter valve. The valve 102 can be operably coupled to the actuator 90 to selectively open and close the water line 98 to selectively provide water to the faucet 84.

The valve 102 can be supplied with both the hot water supply 45 and the cold water supply 46 and can control the temperature based upon instruction from the actuator 90. The actuator 90 can allow a user to choose the temperature of water supplied to the second container 83 by operating valves associated with the hot water supply 45 or the cold water supply 46 from the valve 102. Alternatively, water temperature can be controlled at the user interface.

Upon actuation of the actuator 90, the valve 102 can provide the supply of water 44 to the water line 98 through the valve 102. The supply of water 44 is passed to the second container 83 and can then exit the faucet 84 at the outlet 86. Thus, the supply of water can be used to saturate a laundry item with the supply of water 100, while still containing spill-over water within the treating chamber 32.

The faucet 84 can dispense water alone, or water mixed with treating chemistry. For example, the supply of water provided by the faucet 84 can include a stain treating chemistry to pre-treat laundry items prior to washing. A user can fill the second container 83 with a pre-treating chemistry or other treating chemistry prior to actuation of the actuator 90. At actuation of the actuator 90 the supply of water passes through the second container 83 to mix with the treating chemistry to form a mixed supply. The mixed supply exists the outlet 86 and is supplied from the faucet 84 to the treating chamber for pre-treatment of laundry. Alternately, if the user does not fill the second container 83 with a treating chemistry and the supply of water does not mix with treating chemistry.

In use, the user can open the drawer 80 and fill the second container 83 with a volume of treating chemistry, such as a stain-treatment. The user can close drawer 80 with the treating chemistry retained in the second container 83. The user can then actuate the actuator 90 to provide the supply of water 100 to the second container 83 to mix with the treating chemistry. The mixture of water and treating chemistry is dispensed from the faucet 84 where a user can use the mixture of water and treating chemistry to at least partially saturate a laundry item. The user can then treat the laundry item, such as by rubbing the laundry item with the user's hands or by using a brush, sponge, or other suitable treatment utensil. Alternatively, the user could simply wet the laundry item with the mixture of water and chemistry prior to running a cycle of operation, without treating the laundry item, to provide for increased treatment to desired laundry items or portions of laundry items.

The dispenser 54 obviates the need for an external sink or space for pre-washing or pre-treating laundry. Having the faucet 84 integrated into the dispenser 54 can enable a user to pre-treat laundry items prior to running a cycle of operation, while containing any liquid or treating chemistry within the treating chamber of the washing machine. The dispenser 54 also minimizes or eliminates additional space otherwise required to route the supply of water 100 as the supply of water 100 can already be supplied to the dispenser 54 for providing treating chemistry to the treating chamber.

Figure 6:
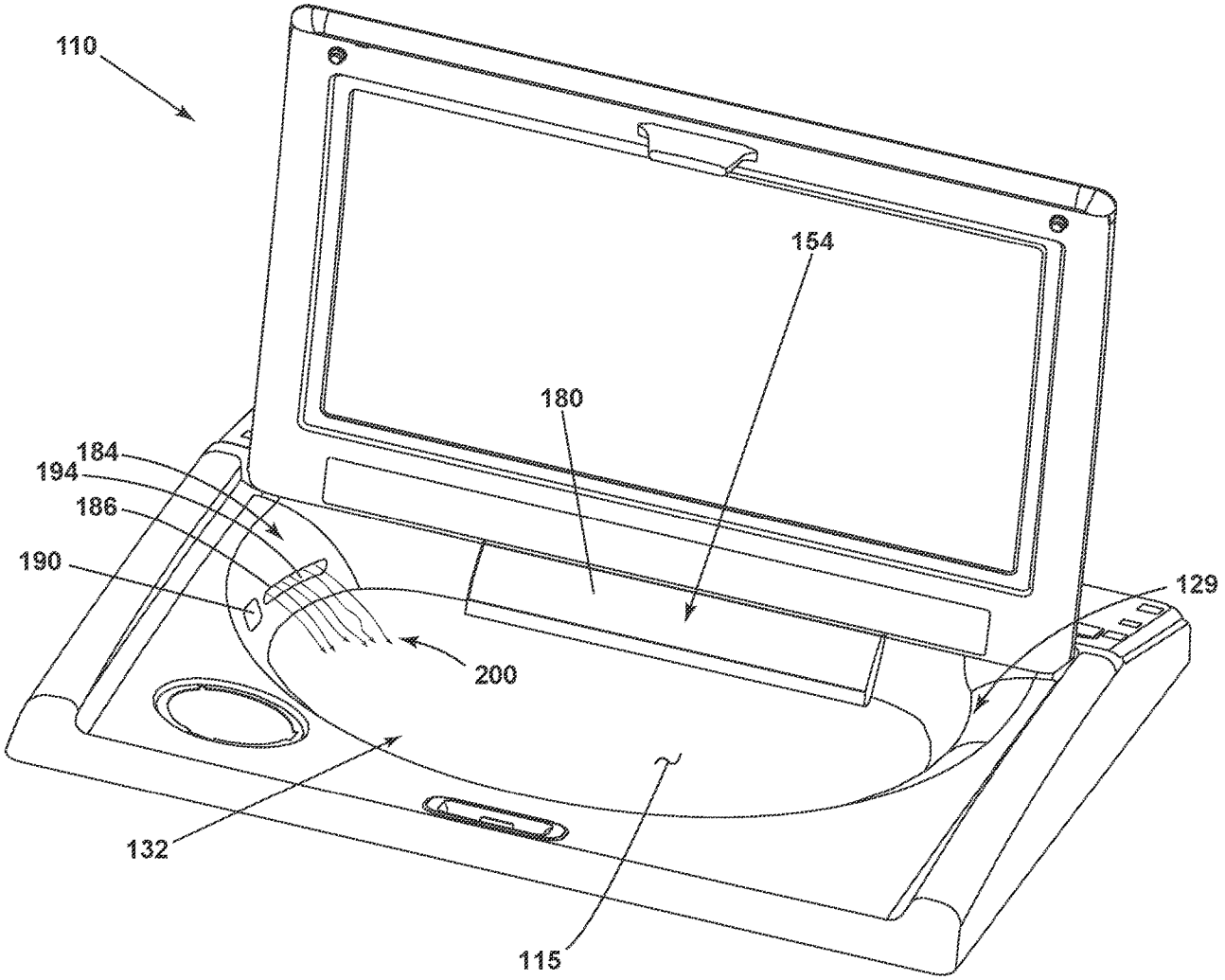
FIG. 6 illustrates a top perspective view of a laundry treating appliance having an alternative dispenser according to various aspects described herein.

FIG. 6 illustrates an alternative dispenser 154 provided within a laundry treating appliance 110. The laundry treating appliance 110 of FIG. 6 can be substantially similar to the laundry treating appliance 10 of FIGS. 1-5. Therefore, like parts will be identified with like numerals increased by a value of one hundred, with discussion being limited to differences between the two.

As shown in FIG. 6, a faucet 184 is spaced from a drawer 180 of the dispenser 154. Alternatively, it is contemplated that faucet 184 can be adjacent the drawer 180. The drawer 180 is slidable between a first position and a second position, similar to the drawer 80 of FIGS. 3 and 4, and is shown here in the closed, first position. An outlet 186 for the faucet 184 is fluidly coupled to a treating chamber 132 and can be located on or within the shroud 129 or other mechanical structures associated with the treating chamber 132 or access opening 115. The outlet 186 can be in the form of an aperture 194 provided in the shroud 129. An actuator 190 can be provided on the shroud 129 and can be adjacent the aperture 194, spaced from the dispenser 154. However it is contemplated that the actuator 190 can be adjacent to or positioned on the drawer 180, adjacent to the aperture 194, at any suitable position around the shroud 129, or on the user interface 26 in non-limiting examples.

Figure 7:
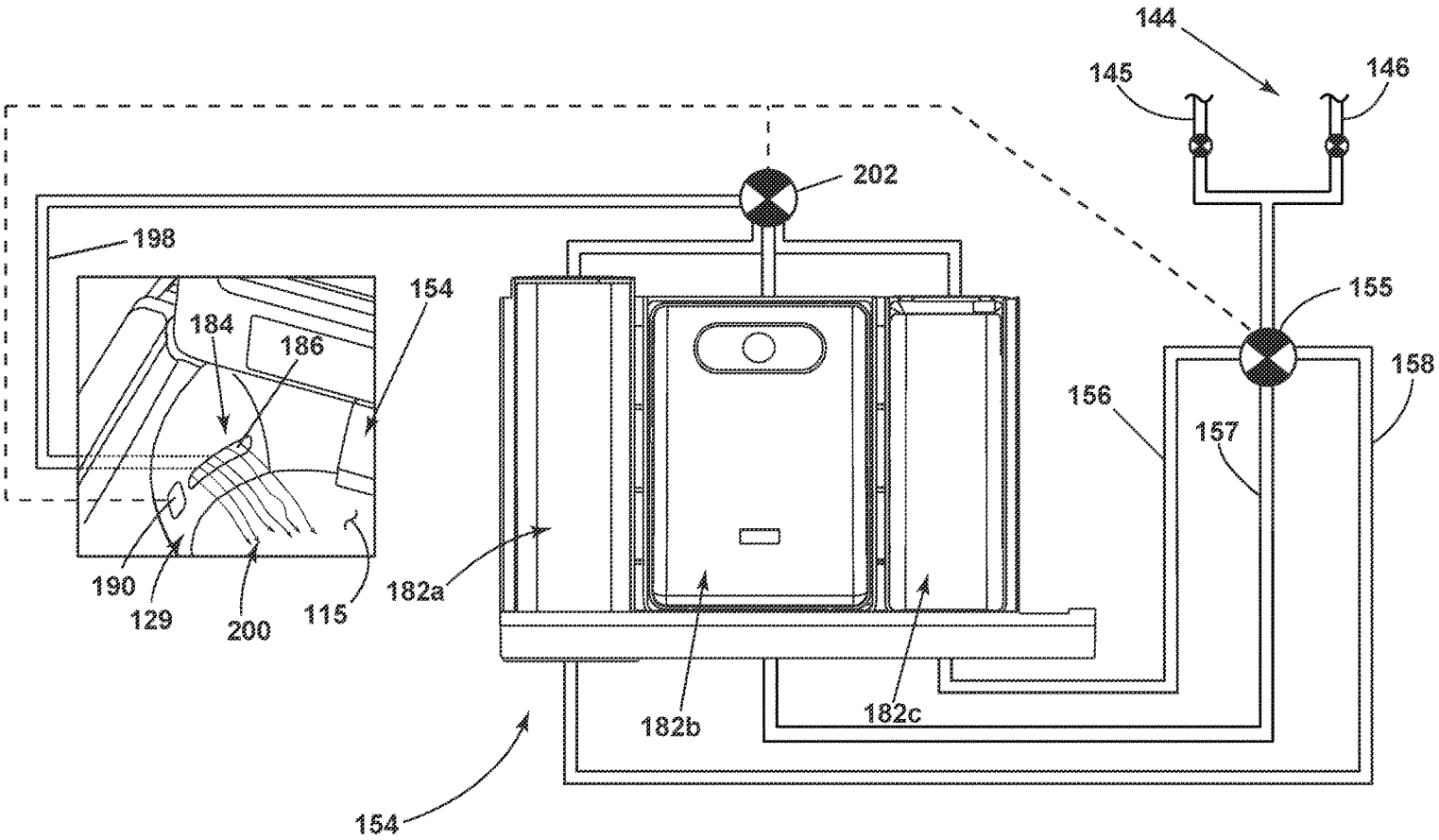
FIG. 7 illustrates a schematic view of the dispenser of FIG. 6.

Referring to FIG. 7, the dispenser 154 can have a set of containers 182. The containers 182 can be organized as three separate containers as a first container 182*a*, a second container 182*b*, and a third 182*c*. The containers 182 can be adapted to hold differing types of treating chemistry such as a detergent, a fabric softener, or a stain repellent.

A first conduit 156, a second conduit 157, and a third conduit 158 can fluidly couple the water supply 144 to the first container 182*a*, the second container 182*b*, and the third container 182*c*, respectively, while any flow combination is contemplated. A diverter valve 155 can join the water supply line 144 to the conduits 156, 157, 158. The diverter valve 155 can selectively divert hot or cold water supplies 145, 146 to the first, second, or third conduits 156, 157, 158, to selectively provide hot, cold, or mixed water to the first, second, or third containers 182*a*, 182*b*, 182*c*. Such provision can be determinative of a cycle of operation or user selection at the user interface 26. Furthermore, the diverter valve 155 can be operably coupled to the actuator 190, such that actuation of the actuator 190 can be used to select a desired temperature.

A water supply line 198 can extend between the containers 182 and the faucet 184 and can fluidly couple the dispenser 154 to the faucet 184. A valve 202 can be provided along the water supply line 198 to selectively open and close the water supply line 198, in order to selectively fluidly couple the dispenser 154 to the faucet 184. While illustrated as fluidly coupling all three containers 182 to the faucet 184, it is contemplated that the water supply line 198 can fluidly connect only one container 182 to the faucet 184.

In operation, water is supplied to the dispenser 154 from the water supply 144 through the first, second, and third conduits 156, 157, 158 by the first valve 155. The first valve 155 can be used to control the flow of water as well as the water temperature. From the dispenser 154, the water can be selectively provided to the faucet 184 through the water supply line 198. The valve 202 can control the flow of water through the water supply line 198. At actuation of the actuator 190, the first valve 155, the second valve 202, or both can opened to provide water from the faucet 184.

The supply of water 200 to the faucet 184 can originate from the container 182 either supplied with or not supplied with treating chemistry. A user can load the treating chemistry containers 182 with a desired treating chemistry when the dispenser 154 is in the open position. Then, a user can push the dispenser 154 to the closed position and start the supply of water 200 from the faucet 184. The supply of water 200 passes through the container 182 filled with treating chemistry to form a mixed supply of water and treating chemistry. The mixed supply will be dispensed from the faucet 184 for use in pretreating laundry.

If a user fills the container 182 with a pre-treating chemistry or other treating chemistry, actuation of the actuator 190 opens the diverter valve 155 and water is supplied to the container 182 from at least one of the conduits 156, 157, 158. The hot and cold supplies 145, 146 can supply water to the dispenser at various temperatures. As some treating chemistries perform optimally at different water temperatures it can be advantageous to fill a container 182 that receives a cold, hot, or mixed water with a suitable treating chemistry to mix with the supply of water 200. For example, a stain repellant may perform optimally at cold water temperatures. Therefore a user can fill the container 182 with the stain repellant and control the actuator 190 to supply the container 182 filled with the stain repellent with a supply of water at an optimal, colder temperature.

The dispenser 154 enables a user to pre-treat laundry items prior to running a cycle of operation without the use of an external sink or space. The water or mix of water and treating chemistry will be contained within the treating chamber 132. Thus, the dispenser 154 obviates the need for an external sink or space for pre-treatment of laundry prior to a typical cycle of operation, as any pre-treatment can be done at the washing machine 110 itself.

Figure 8:
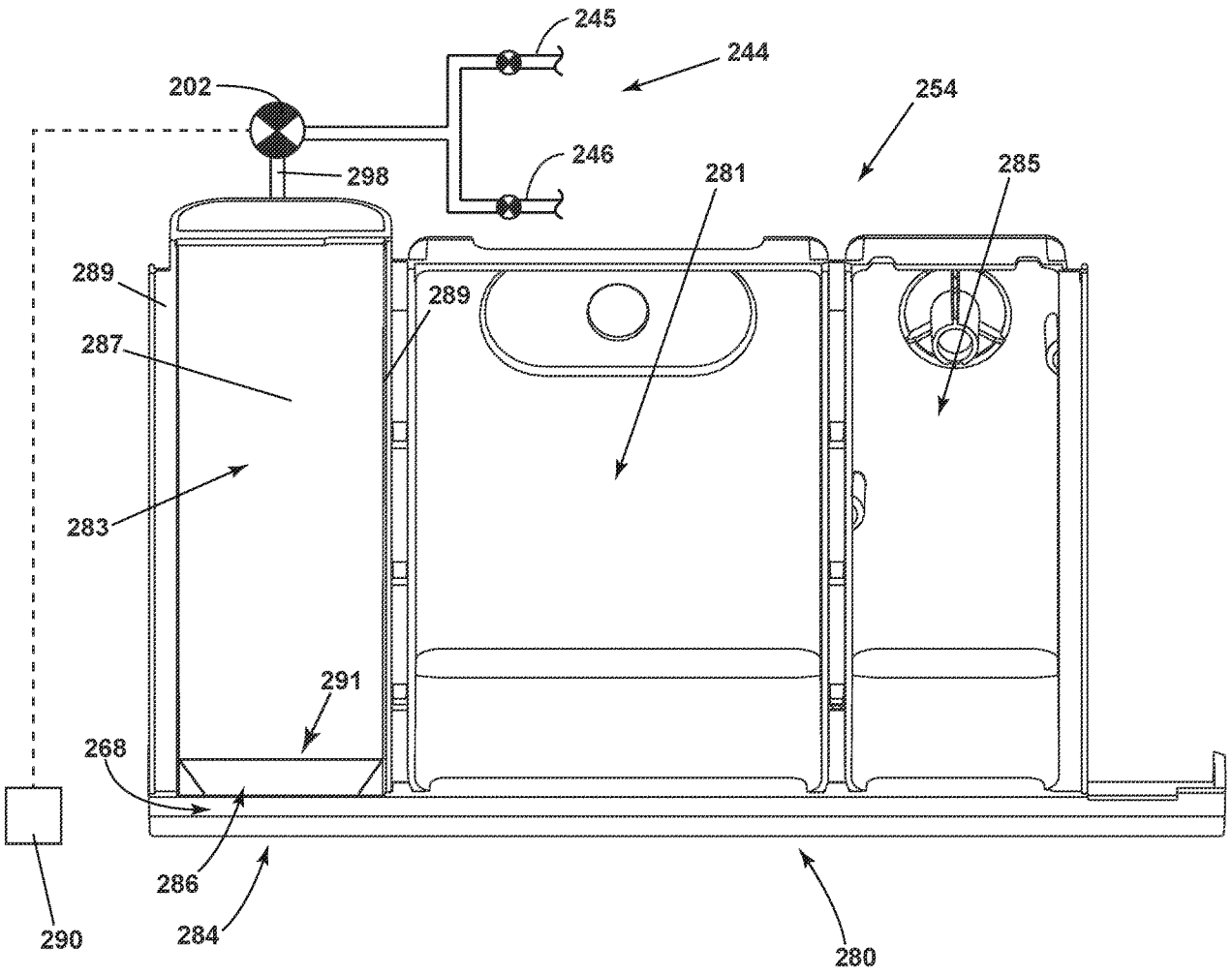
FIG. 8 illustrates an alternative top view of a dispenser drawer having a flood wall according to various aspects described herein.

FIG. 8 illustrates an alternative dispenser 254 provided within a laundry treating appliance 10. The dispenser 254 of FIG. 8 can be substantially similar to the dispenser 54 of FIGS. 1-5. Therefore, like parts will be identified with like numerals increased by a value of two hundred, with discussion being limited to differences between the two.

A top view of the dispenser drawer 280 having at least one container 283 is shown schematically coupled to the water supply 244. A flood wall 291 can block a portion of the flow path defined within the container 283. The flood wall 291, can be a walled structure coupled to the second container 83 such that water can be directed to flow up and over the flood wall 291 and out of the outlet 86. Stated in another way, the flood wall 291 acts as a spillway and a lower portion of the flood wall 291 adjacent the bottom 287 of the container 283 will direct the flow of water upwards and over the flood wall 291 towards the outlet 286. It should be appreciated that the outlet 286 and the faucet 284 can be provided in a variety of forms, such that a flow path is integrated into the dispenser and provided from the faucet 284 to the treating chamber.

In a traditional vertical axis laundry treating appliance a user cannot use a water supply from the laundry treating appliance prior to running a cycle of operation to pre-treat laundry items. Integration of a water supply in accordance with the present disclosure enables a user to pre-treat laundry items prior to running a cycle of operation without the use of an external sink or space. For example, a user can start the supply of water from the faucet to saturate a laundry item with water and the water will be contained within the treating chamber. Aspects of the present disclosure also provide for a mix of water and treating chemistry, at various temperatures, to flow from the faucet to saturate a laundry item for pre-treatment.

To the extent not already described, the different features and structures of the various embodiments can be used in combination with each other as desired. That one feature may not be illustrated in all of the embodiments is not meant to be construed that it cannot be, but is done for brevity of description. Thus, the various features of the different embodiments can be mixed and matched as desired to form new embodiments, whether or not the new embodiments are expressly described. All combinations or permutations of features described herein are covered by this disclosure.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A laundry treating appliance comprising:

a cabinet defining an interior and having an access opening to the interior;

a treating chamber located within the interior and accessible through the access opening;

a pre-treatment faucet having an actuator accessible by a user and an outlet fluidly coupled to the treating chamber, the pre-treatment faucet configured for pre-treating a laundry item prior to the laundry treating appliance beginning an automatic cycle of operation; and a treating chemistry dispenser having at least one container, wherein:

at least one container directs a pre-treatment water flow from a water supply to the outlet of the pre-treatment faucet through the at least one container of the treating chemistry dispenser in response to user actuation of the actuator, and wherein the pre-treatment faucet can dispense water mixed with treating chemistry; and at least one container dispenses treating chemistry during operation of the laundry treating appliance.

2. The laundry treating appliance of claim 1 wherein the at least one container includes multiple containers.

3. The laundry treating appliance of claim 2 wherein the multiple containers includes a first container for receiving detergent and a second container for receiving fabric softener.

4. The laundry treating appliance of claim 2 wherein the containers can hold differing types of treating chemistry.

5. The laundry treating appliance of claim 4 further comprising a hot water supply connected to a first one of the containers, a cold water supply connected to a second one of the containers, and a mixed hot and cold water supply connected to a third one of the containers.

6. The laundry treating appliance of claim 2 further comprising a cold water supply connected to the at least one of the containers.

7. The laundry treating appliance of claim 1 wherein the outlet of the pre-treatment faucet is spaced from the at least one container.

8. The laundry treating appliance of claim 7 wherein the outlet is spaced from the treating chemistry dispenser.

9. The laundry treating appliance of claim 8 wherein the cabinet comprises a shroud defining the access opening and the outlet is located on the shroud.

10. The laundry treating appliance of claim 9 wherein the shroud comprises an aperture defining the outlet.

11. The laundry treating appliance of claim 10 wherein the pre-treatment faucet comprises a conduit connecting the at least one container to the aperture.

12. The laundry treating appliance of claim 11 further comprising the actuator for the pre-treatment faucet provided on the shroud.

13. The laundry treating appliance of claim 12 wherein the actuator is adjacent the aperture.

14. The laundry treating appliance of claim 12 further comprising a water supply line fluidly coupled to the at least one container and a valve fluidly coupled to one of the water supply line and the conduit, and the actuator is operably coupled to the valve.

15. The laundry treating appliance of claim 1 wherein the treating chemistry dispenser comprises a drawer and the at least one container is carried by the drawer.

16. A laundry treating appliance comprising:

a cabinet defining an interior and having a shroud defining an access opening to the interior;

a basket located within the interior, the basket having an open top and rotatable about a vertical axis;

a faucet having an outlet located within the shroud;

a treating chemistry dispenser drawer carrying the faucet, the treating chemistry dispenser drawer having containers and slidable relative to the shroud between a first position, where at least one of the containers underlies the shroud, and a second position, where the at least one of the containers extends at least partially beyond the shroud and overlies the basket; and a pre-treatment water supply comprising:

a water line fluidly coupled to at least one of the containers;

a conduit coupling the at least one of the containers to the outlet of the faucet;

a valve; and an actuator accessible by a user, wherein actuation of the actuator controls an opening/closing of the valve to control a supply of water to the outlet of the faucet via the at least one of the containers of the treating chemistry dispenser drawer, and wherein the faucet can dispense water mixed with treating chemistry.

17. The laundry treating appliance of claim 16 wherein the containers can hold differing types of treating chemistry.

18. The laundry treating appliance of claim 16 further comprising a hot water supply connected to a first one of the containers, a cold water supply connected to a second one of the containers, and a mixed hot and cold water supply connected to a third one of the containers.

19. The laundry treating appliance of claim 16 further comprising a cold water supply connected to the at least one of the containers.

20. The laundry treating appliance of claim 16 wherein the actuator is located on one of the shroud or the treating chemistry dispenser drawer, or adjacent the outlet.

* * * * *